US006257434B1

(12) United States Patent
Lizzio

(10) Patent No.: US 6,257,434 B1
(45) Date of Patent: Jul. 10, 2001

(54) CONTAINER FOR TRANSPORTING HEATED FOOD, PARTICULARLY PIZZA AND THE LIKE

(75) Inventor: Filippo Lizzio, Volpiano (IT)

(73) Assignee: Agape Trade AG, Geneva (CH)

( * ) Notice: Subject to any disclaimer, the term of this patent is extended or adjusted under 35 U.S.C. 154(b) by 0 days.

(21) Appl. No.: 09/419,882

(22) Filed: Oct. 18, 1999

(30) Foreign Application Priority Data

Jul. 16, 1999 (EP) ..... 99113914

(51) Int. Cl.[7] ..... B65D 85/62

(52) U.S. Cl. ..... 220/4.23; 220/366.1; 206/551; 206/204; 426/119; 426/128; 99/DIG. 15

(58) Field of Search ..... 206/551, 204; 426/119, 128; 220/4.23, 366.1; 99/DIG. 15

(56) References Cited

U.S. PATENT DOCUMENTS

| | | | | |
|---|---|---|---|---|
| 4,373,636 | * | 2/1983 | Hoffman | 206/551 |
| 4,848,543 | * | 7/1989 | Doboze | 206/551 |
| 5,076,434 | * | 12/1991 | Hoffman, Jr. | 206/551 |
| 5,423,477 | * | 6/1995 | Valdman et al. | 206/551 |
| 5,543,606 | * | 8/1996 | Gics | 219/730 |
| 5,605,231 | * | 2/1997 | Borsboom et al. | 206/551 |
| 5,662,237 | | 9/1997 | Cain . | |

FOREIGN PATENT DOCUMENTS

| | | |
|---|---|---|
| 2 116 203A | 7/1972 | (FR) . |
| WO 94 12397A | 6/1994 | (WO) . |
| WO 95 29619A | 11/1995 | (WO) . |

* cited by examiner

*Primary Examiner*—Joseph M. Moy
(74) *Attorney, Agent, or Firm*—Sughrue, Mion, Zinn, Macpeak & Seas, PLLC

(57) ABSTRACT

Container for transporting heated food, particularly pizza and the like, formed by a first and a second half-shell of moulded plastic material each having a bottom wall and a lateral wall with mutually substantially sealed coupling means to define, in the coupled condition, a cavity for containing food and communicating to the outside through vent openings.

12 Claims, 5 Drawing Sheets

CONTAINER FOR TRANSPORTING HEATED FOOD, PARTICULARLY PIZZA AND THE LIKE

BACKGROUND OF THE INVENTION

The present invention is related to containers for transporting heated food, particularly pizzas, hamburgers and more generally fast-food products.

These food products, purchased in a warm condition at the production site and then transferred to the place where they shall then be taken, are subjected not only to progressive cooling but also to contamination by the steam generated by themselves and then condensed following cooling.

The transporting containers presently used, traditionally consisting of simple cardboard boxes, are all affected by the above-referenced drawback, whereby the organoleptic characteristics of the food products housed therein are more or less lowered, often without any chance to be restored not even by subjecting the foodstuffs to further heating.

Moreover these known containers formed by cardboard boxes are affected by encumbrance problems, whereby they are normally provided in a flattened transport and storage condition: at the time of use these containers are then brought to an erected condition for receiving the food products thereinto. This operation may be uncomfortable and involve loss of time.

SUMMARY OF THE INVENTION

The object of the present invention is to overcome the above inconveniences, and more particularly to provide a container for transporting heated food having a simple and economical construction, adapted to efficiently ensure preserving not only the temperature but even the fragrance of the warm food product contained therein, and moreover having a reduced encumbrance even in a transporting and stocking ready-to-use condition.

According to the invention this object is achieved primarily due to the features set forth in claim 1.

Additional secondary features of the invention are defined in subclaims 2–15.

BRIEF DESCRIPTION OF THE DRAWINGS

The invention will now be disclosed in detail with reference to the accompanying drawings, purely provided by way of non limiting example, in which.

DETAILED DESCRIPTION OF THE INVENTION

Figure 1:
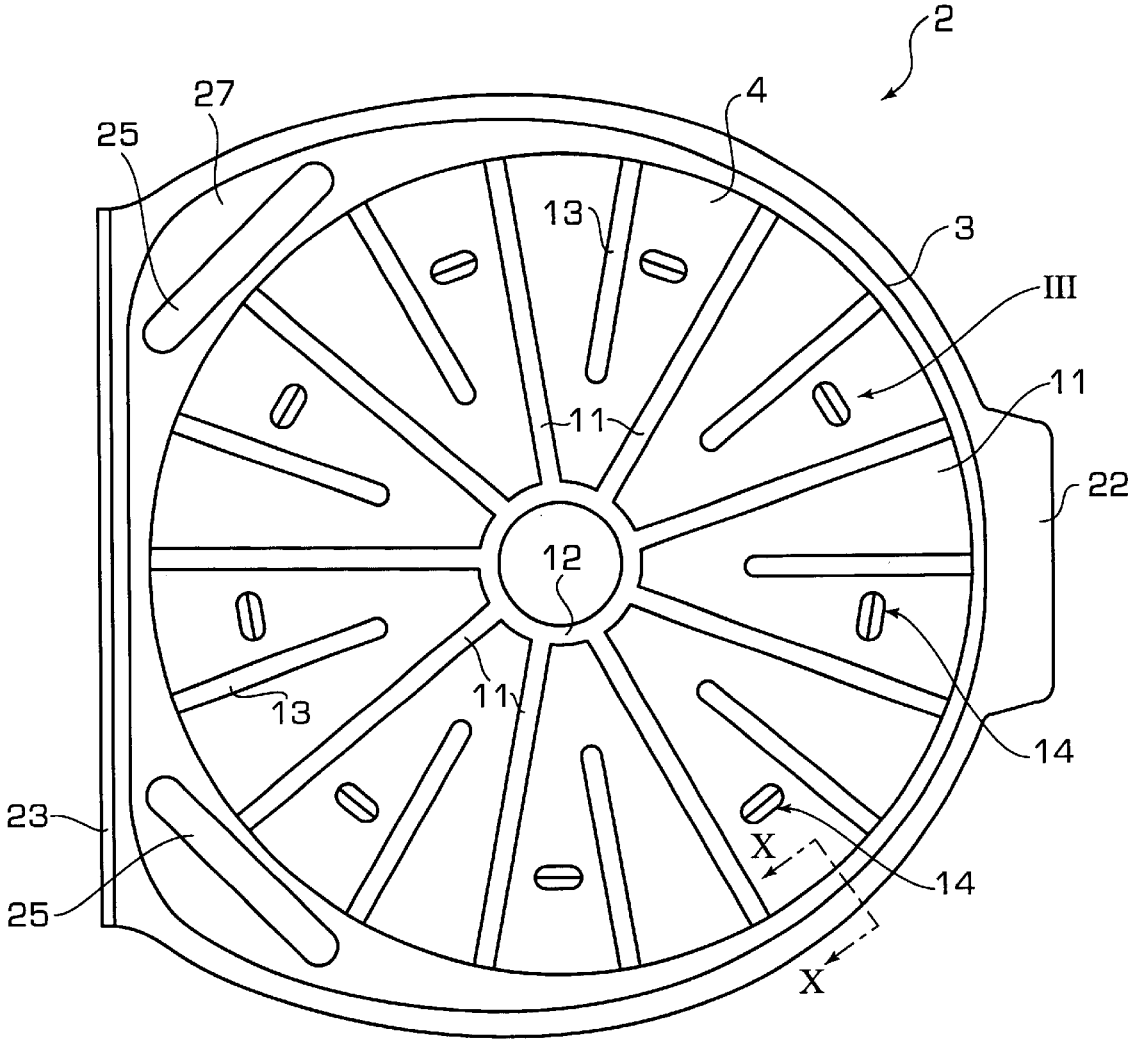
FIG. 1 is a top plan view diagrammatically showing a preferred embodiment of the container according to the invention in a closed condition of use.

FIGS. 1 through 5 show a first embodiment of the invention, which is to be considered as the preferred embodiment, with specific reference to a container for transporting a pizza. In the shown example the container shape and size are thus suitable to house the pizza therein: obviously, design and size can be tailored to different foodstuffs, such as hamburgers, fast-food products and warm take-away food in general.

According to the preferred embodiment of FIGS. 1 through 5, the container of the invention is formed by one single piece P of thin sheet-like moulded plastic material, defining a lower half-shell 1 and an upper half-shell 2 both having a substantially circular shape with a respective bottom wall 3, 4 and a respective lateral wall 5, 6.

The bottom wall 3 of the lower half-shell 1 is formed, in correspondence of the inner face thereof, with a radial array of straight ribs 7 projecting upwardly and starting from a central annular rib 8 having a circular design. Moreover further pairs of shorter ribs 9, between which radial recesses 10 formed as channels are provided, are provided between each pair of adjacent ribs 7.

The radial recesses 10, whose function shall be clarified herebelow, are extending also over the inner surface of the lateral wall 5 of the lower half-shell 1.

Respective recesses are corresponding, on the outer face of the bottom wall 3, to the ribs 7, 8 and 9, while on the same outer face respective ribs are corresponding to the recesses 10.

Figure 3:
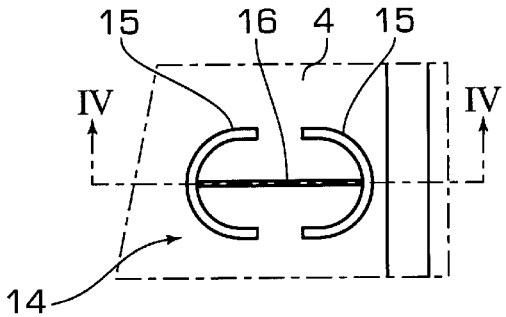
FIG. 3 shows in a larger scale the detail indicated by arrow III in FIG. 1.
Figure 4:
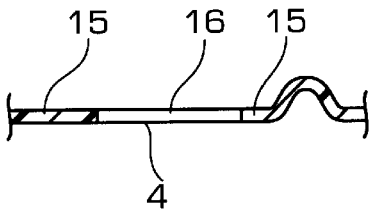
FIG. 4 is a sectioned view along line IV—IV of FIG. 3.
Figure 2:
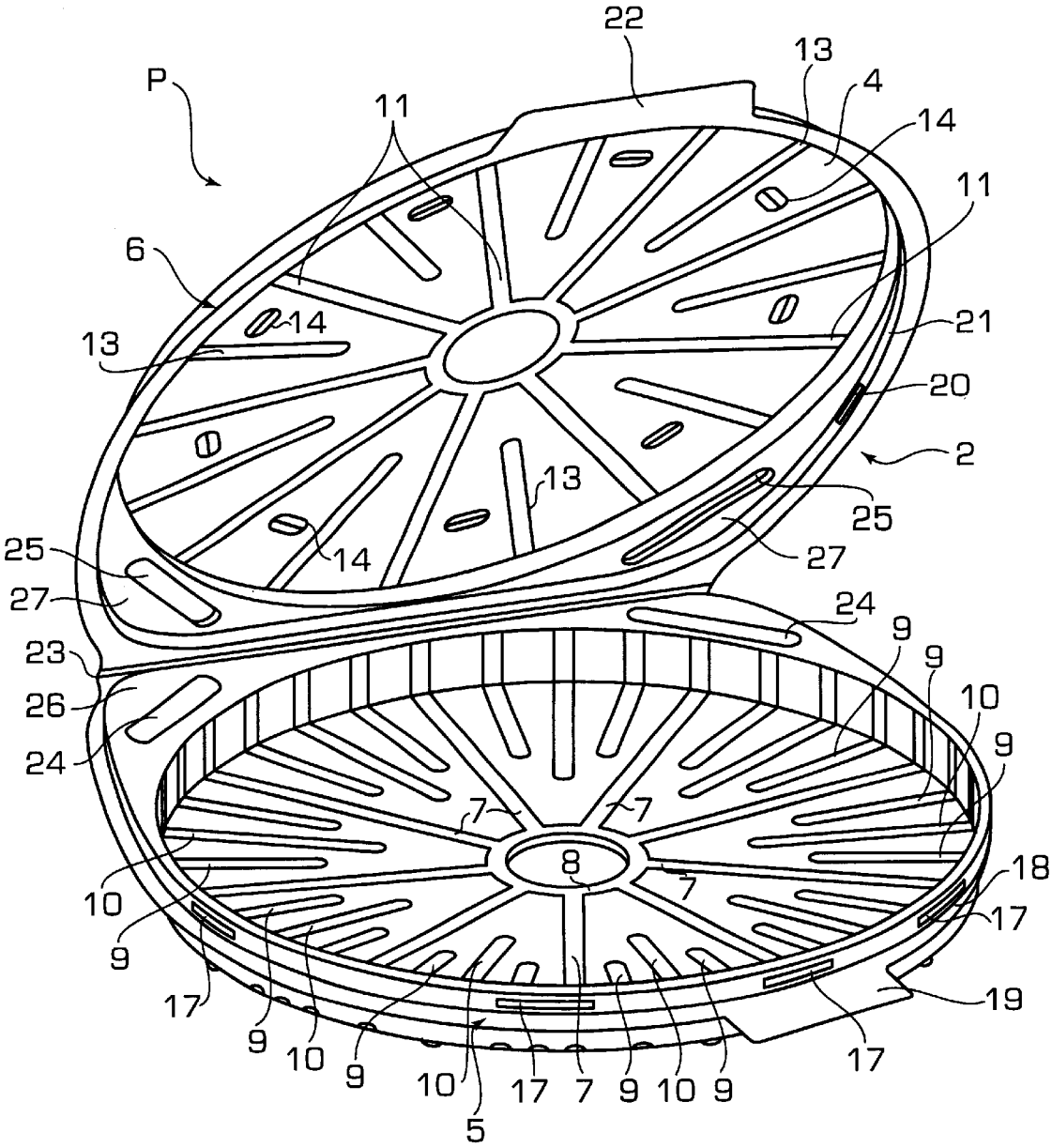
FIG. 2 is a perspective view of the container of FIG. 1 shown in a partially open condition.

Likewise the bottom wall 4 of the upper half-shell 2 is formed, in correspondence of its inner face, with a radial array of straight ribs 11 starting from an annular central rib 12 also having a circular design. A shorter central radial rib 13 is provided between each pair of ribs 11. Moreover, vent openings 14 are arranged in selected areas comprised between the ribs 11 e 13. These vent openings 14 are arranged according to a crown concentric to the half-shell 2 and, as shown in detail in FIGS. 3 and 4, are each formed by a partial die-cut having a generally elliptical shape, actually defined by two juxtaposed substantially semi-circular cuts 15 mutually joined by a central longitudinal cut 16.

The lateral walls 5, 6 of the two half-shells 1, 2 are designed to perform a mutual substantially sealed closure connection. Thus, the lateral wall 5 of the lower half-shell 1 is formed superiorly with a series of elongated recesses 17 below which an annular flange 18 is provided, forming a forwardly projecting tang 19. Likewise, the lateral wall 6 of the upper half-shell 2 is formed inferiorly with a series of elongated projection 20 having a shape complementary to that of the recesses 17, and superiorly with an annular flange 21 forming a forwardly projecting tang similar to the tang 19 of the lower half-shell 1.

In the rear side, the two lateral walls 5, 6 of the half-shells 1, 2 are prolonged so as to form a straight connection book-like pivot hinge between the two half-shells 1 and 2. Thus the half-shells 1, 2 can be pivoted relative to each other between the closed position shown in FIG. 1, in which they define a cavity adapted to house a pizza, and a completely open position in which they are positioned one along the other, through the partially open position depicted in FIG. 2. In the closed position the annular flange 21 of upper half-shell 1 rests upon the annular flange 18 of the lower half-shell 1, with the projections 20 of the former fitted under pressure within the recesses 17 of the latter. Further recesses 24 and complementary projections 25 may be additionally provided to hold the closure position, for instance formed in respective wings 26, 27 of the lateral walls 5, 6 near to the pivot hinge 23 and mutually engageable under pressure.

In use, the ribs 7, 8, 9 of the bottom wall 3 of the lower half-shell 1 act as spacer element bearing the pizza housed in the cavity defined by the half-shells 1, 2 closed onto each other. Interspaces communicating with the recesses 10 are thus defined between the pizza and the bottom wall 3, acting both as chambers collecting any steam generated by the pizza itself and condensed, and as chimneys—along the respective portions formed on the lateral wall 5—for discharging smoke and steam upwardly. Likewise the ribs 11, 13 of the upper half-shell define, between the bottom wall thereof and the pizza within the container, a plurality of interspaces communicating to the outside through the vent openings 14.

By this arrangement, the hot pizza housed within the cavity of the container is efficiently kept, at least over the time necessary for transporting it from the production site to the place where it shall be eaten, at a substantially constant temperature and humidity on one hand by virtue of the thermal insulation performed by the half-shells 1, 2 closed onto each other in a substantially hermetical fashion, and on the other hand by virtue of the steam outlet through the previously disclosed interspaces to the outside of the container through the vent openings 14, in practice without appreciably affecting the fragrance of the pizza housed within the container.

Figure 5:
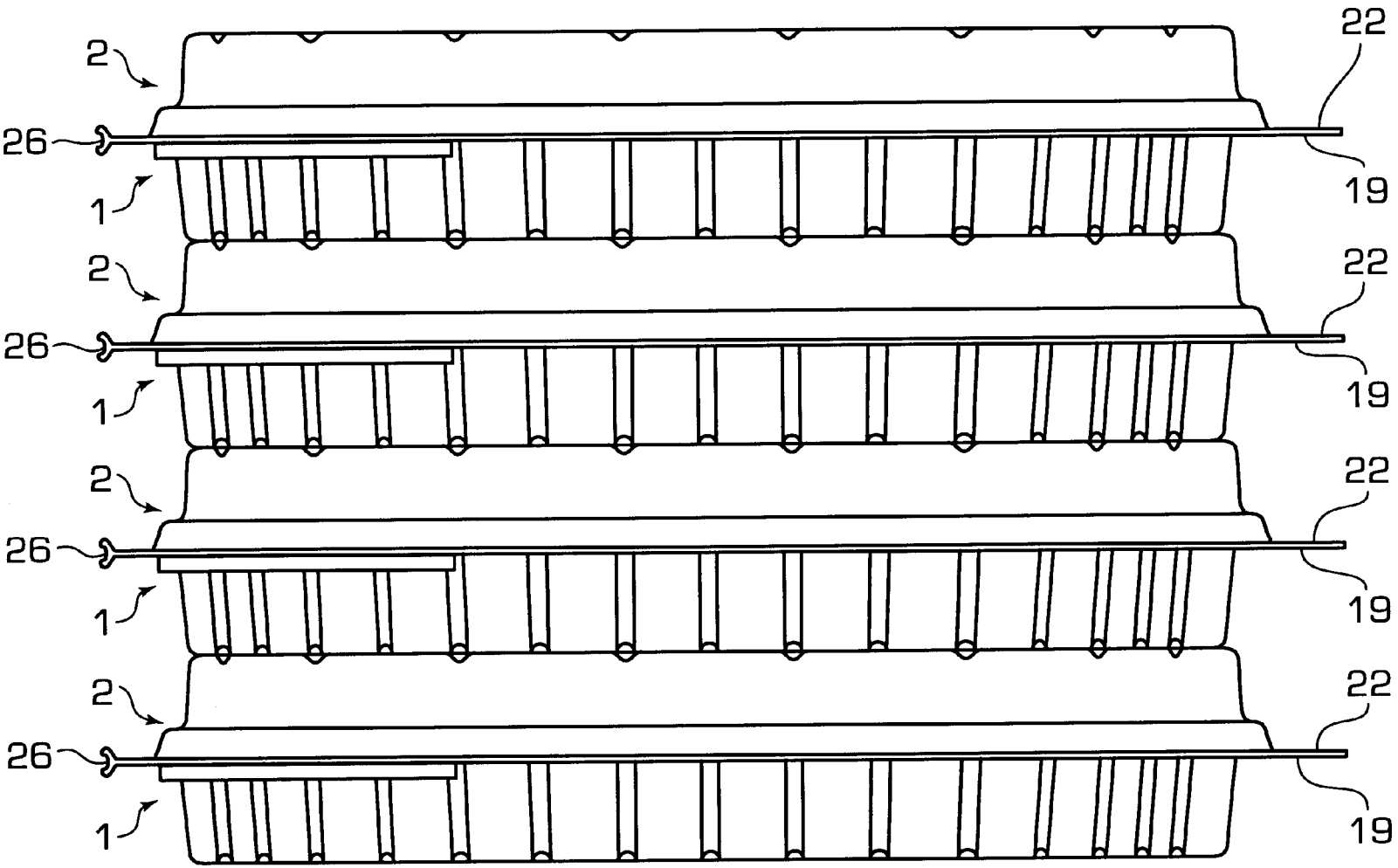
FIG. 5 is a lateral elevational view showing the container of FIG. 1 in a stacked condition with identical containers.
Figure 6:
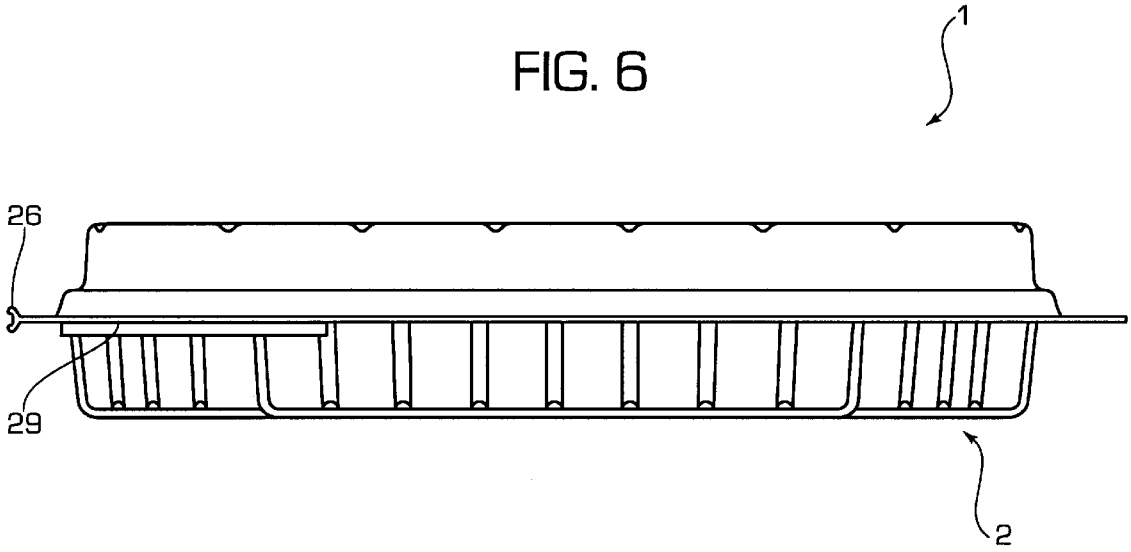
FIG. 6 is an elevational view showing an alternative embodiment of the container according to the invention.

The previously disclosed arrangement of the ribs and recesses on the bottom walls 3, 4 of the half-shells 1 and 2 enables conveniently stacking a plurality of containers according to the invention in the closed condition onto one another, such as shown in FIG. 5. The projections defined by the recesses 10 on the lower face of the bottom wall 3 of the lower half-shell 1 of a container placed above fit into the recesses defined, on the upper face of the bottom wall 4 of the upper half-shell 2 of the container placed below, by the ribs 13. This ensures a steady positioning in the stacked condition, preventing undesired sliding between the superimposed containers.

To open the container 1 it is sufficient disengaging the projections 20 from the recesses 17, pulling manually the front wings 19, 22 apart so as to mutually pivot the half-shells 1, 2 around the hinge 23.

For transportation and storage the containers according to the invention may be more conveniently mutually superimposed and stacked, instead than in the closed condition of FIG. 5, arranging the respective half-shells 1, 2 in the completely open position, i. e. one on the prolongation of the other.

The variant of the invention shown in FIGS. 6 through 9 is generally similar to the embodiment disclosed in the above, and only the differences shall be disclosed in detail, employing the same reference numerals for identical or similar parts.

Figure 8:
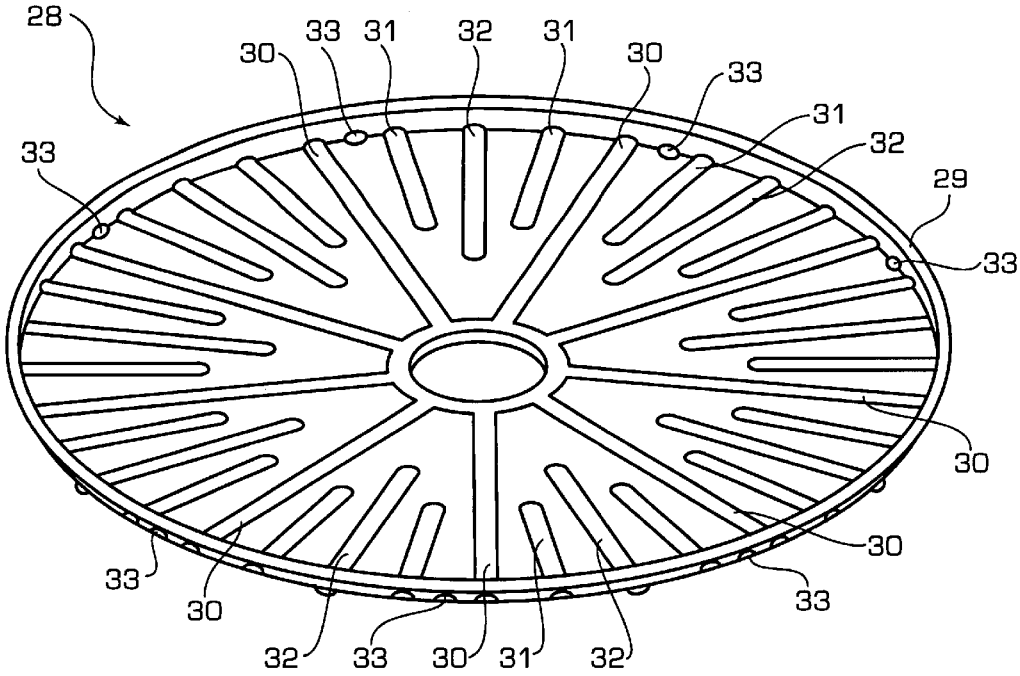
FIG. 8 is a perspective view of a detail of FIG. 7.
Figure 7:
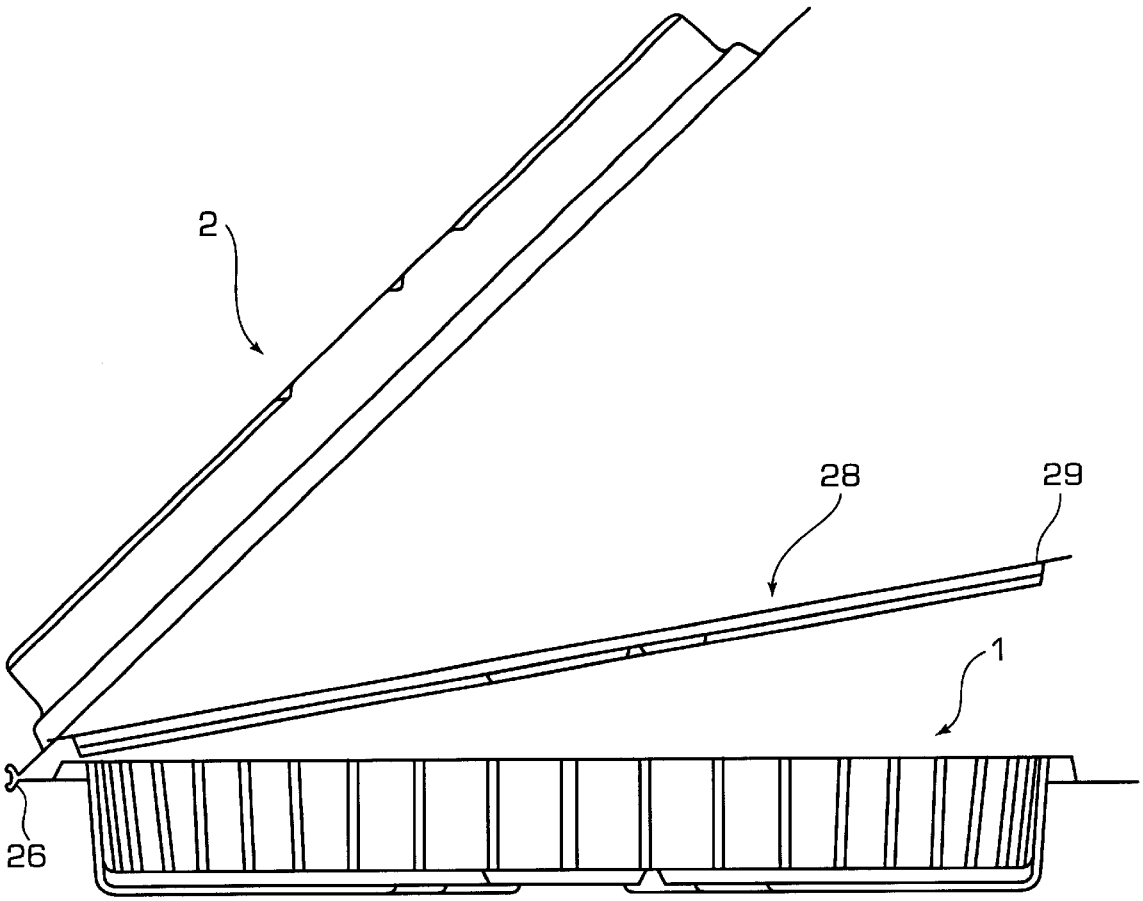
FIG. 7 is a view same as FIG. 6 but sectioned, with the container in a partially open condition.
Figure 9:
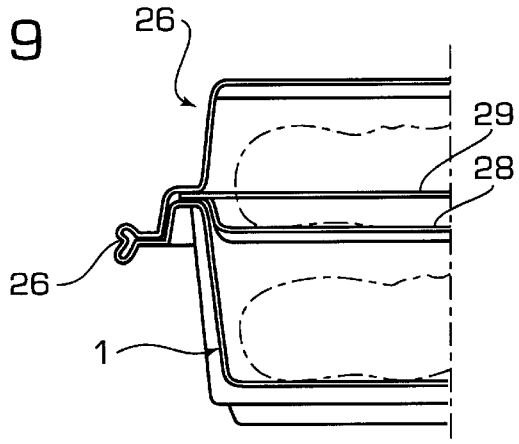
FIG. 9 is a partial vertically sectioned and enlarged view of the container of FIG. 6.
Figure 10:
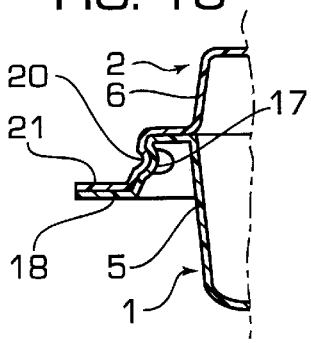
FIG. 10 is a sectioned and enlarged view along line X—X of FIG. 1.

In this variant, the half-shells 1, 2 have a greater height than in the case of the previously disclosed embodiment, and such to enable fitting two superimposed pizzas, instead of only one, within the cavity of the container. An intermediate releasable septum 28 is provided for separating the two pizzas from each other, which is shown in detail in FIG. 8 and whose general configuration can be conveniently the same as the bottom wall 3 of the lower half-shell 1. Thus the intermediate septum 28 has, as shown in FIG. 8, a circular shape with a perimetral flange 29 bearing onto the upper edge of the lateral wall 5 of the lower half-shell 1, and is formed on its upper face with a radial array of ribs 30, 31 similar to the ribs 7, 8, and with channel-like radial recesses 32 similar to the recesses 10 and providing the same function with reference to the pizza placed in use within the upper portion of the container. Moreover the intermediate septum 28 is formed with a crown of peripheral vent openings 33 whose function is corresponding, with reference to the pizza placed in use within the lower part of the container, to that of the openings 14. Naturally the arrangement of these vent openings 33, to which valve means may also be associated, can be different from that shown by way of example in FIG. 8.

It is to be pointed out that the container according to the invention is not necessarily disposable, and that it can be re-used even several times.

The material employed for the manufacturing of the half-shells 1, 2 can be any plastic material conventionally used for the production of food containers, and anyway a heat-formable plastic material. Instead of a thin wall construction, each half-shell 1, 2 may also be provided with a cellular structure, capable to ensure higher thermal insulating performances.

Naturally, the details of construction and the embodiments may be widely varied with respect to what has been disclosed and illustrated, without thereby departing from the scope of the present invention such as defined in the appended claims. Thus, for example, the arrangement of the ribs and recesses of the half-shells 1, 2 as well as that of the vent openings 14 of the half-shell 2 may be different than the one disclosed with reference to the example. In particular the number of the vent openings 14 could be increased or reduced, and in the latter case valve means designed to selectively open communication between the cavity of the container and the outside environment may be associated to the vent openings. These valve means could be manually or even automatically operable.

What is claimed is:

1. A container for transporting heated food, formed by an upper and a lower half-shell made of moulded plastic material, each of said upper and said lower half-shell having a bottom wall and a lateral wall, said upper and said lower half-shell being provided with substantially sealing mutual couplers in correspondence of said lateral walls and defining, in the mutually coupled condition, a cavity for containing said food in a spaced-apart condition relative to the bottom walls of said upper and said lower half-shell, and wherein said bottom wall of said upper half-shell is provided with vent openings, wherein said bottom walls of said upper and said lower half-shell are formed with respective radially extending spacer projections, wherein adjacent spacer projections form channels, and wherein said channels in said bottom wall of said lower half-shell contain radially extending recesses below the plane of the lower half-shell, whereby said channels in said lower half-shell define chimneys for collecting and directing steam radially outwardly and upwardly past the food, the channels in said upper half-shell direct the steam to the vent openings and the recesses in the lower half-shell collect condensed steam.

2. Container according to claim 1, wherein said channels define, on an outer face of said bottom wall of said lower half-shell, projections designed to engage corresponding channels defined, on an outer face of said bottom wall of said upper half-shell, by respective inner projections while the container is placed in a superimposed condition onto another same container.

3. Container according to claim 1, wherein said vent openings include a crown of cuts.

4. Container according to claim 3, wherein said cuts are formed as partial die-cuts.

5. Container according to claim 1, wherein said couplers are mutually press-engageable.

6. Container according to claim 1, wherein said upper and said lower half-shell are made as one single piece and are pivotally connected to each other along a corresponding hinge edge thereof.

7. Container according to claim 1, further comprising an intermediate septum releasably interposed between said upper and said lower half-shell so as to define, in the closed condition thereof, a double cavity.

8. Container according to claim 7, wherein said intermediate septum is also formed with spacer projections, with recesses acting in use as chimneys for discharging smoke and steam and also as collecting chambers of any condensed steam, and with vent openings.

9. Container according to claim 1, wherein said upper and said lower half-shell are constituted by thin flexible heat-formed sheets.

10. Container according claim 1, wherein said upper and said lower half-shell have a cellular structure.

11. Container according to claim 1, further provided with a valve for opening and closing at least one of said vent openings.

12. Container according to claim 8, further provided with a valve for opening and closing at least one of said vent openings.

* * * * *